US009421801B2

(12) United States Patent
Mimoto et al.

(10) Patent No.: US 9,421,801 B2
(45) Date of Patent: Aug. 23, 2016

(54) INKJET RECORDING APPARATUS

(71) Applicant: BROTHER KOGYO KABUSHIKI KAISHA, Nagoya-shi, Aichi-ken (JP)

(72) Inventors: Masao Mimoto, Nagoya (JP); Shota Iijima, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/227,843

(22) Filed: Mar. 27, 2014

(65) Prior Publication Data

US 2015/0091981 A1 Apr. 2, 2015

(30) Foreign Application Priority Data

Sep. 30, 2013 (JP) ..... 2013-205988

(51) Int. Cl.

| | |
|---|---|
| ***B41J 25/304*** | (2006.01) |
| ***B41J 29/02*** | (2006.01) |
| ***B41J 13/076*** | (2006.01) |
| ***B41J 29/13*** | (2006.01) |

(52) U.S. Cl.

CPC ..... *B41J 29/02* (2013.01); *B41J 13/076* (2013.01); *B41J 29/13* (2013.01)

(58) Field of Classification Search

CPC ..... B41J 29/02

USPC ..... 400/352, 59; 347/8, 16, 5, 9

See application file for complete search history.

(56) References Cited

U.S. PATENT DOCUMENTS 5,087,141 A * 2/1992 Kelly ..... 400/352

FOREIGN PATENT DOCUMENTS

JP 2005-330088 A 12/2005

* cited by examiner

*Primary Examiner* — Lam Nguyen

(74) *Attorney, Agent, or Firm* — Merchant & Gould P.C.

(57) ABSTRACT

An inkjet recording apparatus and method of operation are disclosed. One such apparatus includes a carriage configured to support a recording head that is configured to eject ink from nozzles onto a recording medium to be conveyed, and a first support member supporting the carriage. The carriage is movable in a scanning direction orthogonal to a transporting direction of the recording medium. The apparatus further includes a second support member configured to support the first support member and a transporting roller extending in the scanning direction and rotatable to transport the recording medium in the transporting direction. The apparatus also includes a bearing disposed at the second support member and supporting the transporting roller rotatably, the bearing comprising a contact portion that contacts the first support member.

18 Claims, 9 Drawing Sheets

INKJET RECORDING APPARATUS

CROSS-REFERENCE TO RELATED APPLICATION

This application claims priority from Japanese Patent Application No. 2013-205988, filed on Sep. 30, 2013, which is incorporated herein by reference in its entirety.

TECHNICAL FIELD

The present invention relates to an inkjet recording apparatus that records an image on a sheet by ejecting ink droplets from nozzles.

BACKGROUND

Many inkjet recording apparatuses include pairs of rollers that each transport a sheet while nipping the sheet therebetween. Such a pair of rollers includes a transporting roller that rotates by receiving a driving force transmitted thereto from a motor, and a follower roller that faces the transporting roller and rotates by following the rotation of the transporting roller. The transporting roller is rotatably supported by a bearing.

In a known image forming apparatus, a bearing that supports a roller is attached to a frame by inserting the bearing into an opening, provided in the frame, in the axial direction of the roller.

SUMMARY

If, however, a recording unit that records an image on a sheet is supported by a frame that is separate from the frame to which the bearing is attached, the frame serving as a reference for the positioning of the recording unit is provided separately from the frame serving as a reference for the positioning of the bearing. Therefore, the accuracy in the relative positions of the recording unit and the roller that is supported by the bearing may be deteriorated.

In light of the above, the present invention provides a mechanism that improves the accuracy in the relative positions of a recording unit and a roller that is supported by a bearing.

According to the present configuration, a contact portion provided on a bearing is in contact with a first support member from below. The first support member supports a carriage that carries a recording head. Hence, the recording head and a transporting roller are positioned with reference to the first support member. Therefore, the accuracy in the relative positions of the recording head and the transporting roller is improved.

According to one example aspect, an inkjet recording apparatus includes a carriage configured to support a recording head that is configured to eject ink from nozzles onto a recording medium to be conveyed. The inkjet recording apparatus also includes a first support member supporting the carriage, the carriage being movable in a scanning direction orthogonal to a transporting direction of the recording medium. The inkjet recording apparatus includes a second support member configured to support the first support member, and a transporting roller extending in the scanning direction and rotatable to transport the recording medium in the transporting direction. The inkjet recording apparatus further includes a bearing disposed at the second support member and supporting the transporting roller rotatably, the bearing comprising a contact portion that contacts the first support member.

According to a second example aspect, a method of operation of an inkjet recording apparatus is disclosed. The method includes movably mounting a carriage to a first support member, the carriage configured to support a recording head that is configured to eject ink from nozzles onto a recording medium to be conveyed, and positioning a bearing at a second support member, the bearing rotatably supporting a transporting roller that extends in a scanning direction. The method further includes maintaining contact between a contact portion of the bearing and the first support member.

According to a third example aspect, an inkjet recording apparatus includes a carriage configured to support a recording head that is configured to eject ink from nozzles onto a recording medium to be conveyed. The inkjet recording apparatus also includes a guide rail supporting the carriage, the carriage being movable in a scanning direction orthogonal to a transporting direction of the recording medium, as well as at least one side frame supporting the guide rail and a transporting roller extending in the scanning direction and rotatable to transport the recording medium in the transporting direction. The inkjet recording apparatus further includes a bearing attached to the at least one side frame and supporting the transporting roller rotatably, the bearing comprising a contact portion positioned in an opening of the side frame facing the guide rail and contacting the guide rail.

According to some aspects of the present disclosure, the accuracy in the relative positions of the carriage that carries the recording head and the transporting roller that is supported by the bearing is improved.

DESCRIPTION OF THE DRAWINGS

For a more complete understanding of the present disclosure, needs satisfied thereby, and the objects, features, and advantages thereof, reference now is made to the following descriptions taken in connection with the accompanying drawings.

DETAILED DESCRIPTION

Figure 1:
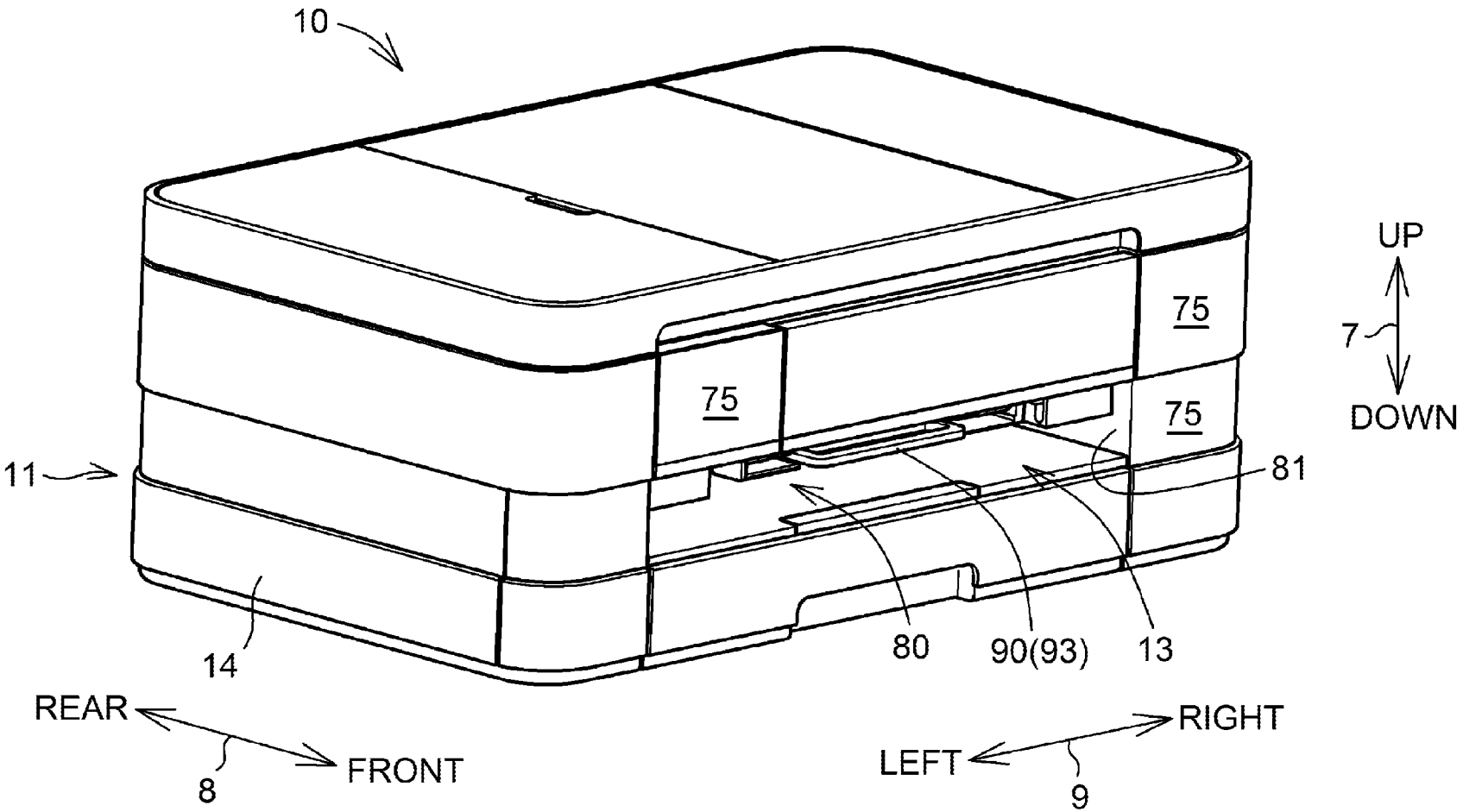
FIG. 1 is a perspective view of an exemplary multifunction machine according to an embodiment of the present invention.

Embodiments of the present disclosure will now be described with reference to the accompanying drawings. The embodiments given below are only an example of the present invention, and any changes can be made thereto without departing from the scope of the present invention. In the following description, a vertical direction 7 (e.g., the "up/down" direction shown in FIG. 1) is defined in a state where a multifunction machine 10 is set in one possible usable manner (the state illustrated in FIG. 1), an anteroposterior direction 8 is defined with a side of the multifunction machine 10 on which an opening 13 is provided being the near side (front side), and a lateral direction 9 is defined when the multifunction machine 10 is seen from the near side (front side).

[Overall Configuration of Multifunction Machine 10]

As illustrated in FIG. 1, the multifunction machine 10 has a substantially rectangular parallelpiped shape with a small thickness and includes a printer section 11 (an exemplary inkjet recording apparatus according to the present invention) on the lower side thereof. The multifunction machine 10 has several functions such as a facsimile function and a printing function. The multifunction machine 10 has, as a printing function, a function of recording an image on one side of a recording sheet 12 (see FIG. 2) in an inkjet manner. The multifunction machine 10 may also have a function of recording an image on each of two sides of the recording sheet 12.

[Feed Tray 20]

Figure 2:
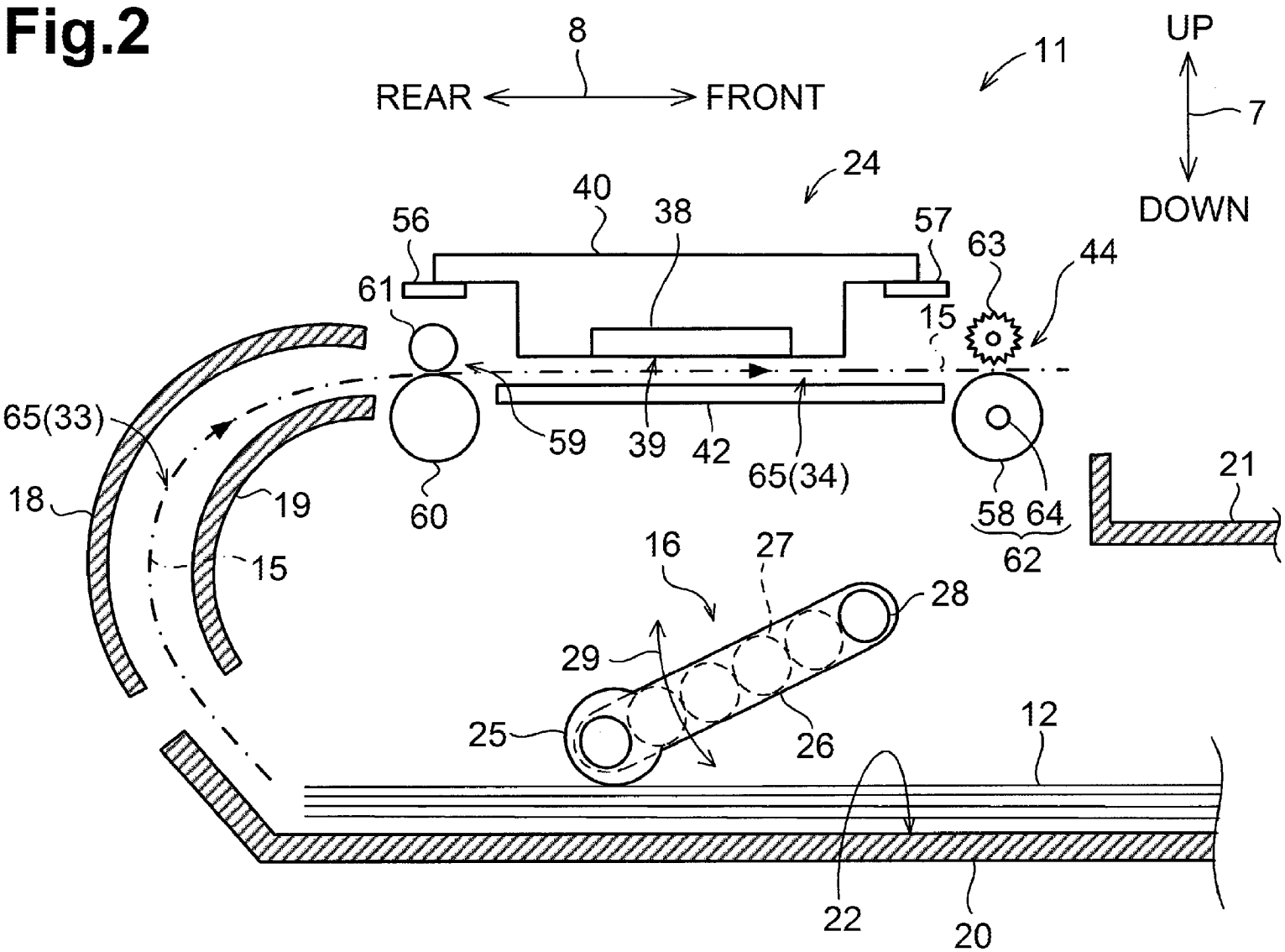
FIG. 2 is a vertical sectional view schematically illustrating an internal configuration of a printer section included in the multifunction machine.

As illustrated in the example shown in FIG. 1, the printer section 11 includes a housing 14. The housing 14 has the opening 13 provided in a front wall 75 thereof. The housing 14 also has a recessed portion 80 on the front side thereof. The recessed portion 80 is recessed rearward from the opening 13. A feed tray 20 is movable in the anteroposterior direction 8, thereby being insertable into and removable from the recessed portion 80 through the opening 13. The feed tray 20 is a box-like member whose upper side is open. As illustrated in FIG. 2, a stack of recording sheets 12 (pieces of an exemplary recording medium according to the present disclosure) is placed on a bottom plate 22 of the feed tray 20. That is, the feed tray 20 is capable of storing recording sheets 12.

[Output Tray 21]

As illustrated in the example of FIG. 2, an output tray 21 is supported on the upper front side of the feed tray 20. The output tray 21 is movable in the anteroposterior direction 8 together with the feed tray 20. The output tray 21 is set in the recessed portion 80 together with the feed tray 20. In such a state, the upper surface of the output tray 21 receives a recording sheet 12 that has been transported thereto by a second pair of rollers 44 to be described separately below.

[Feeding Unit 16]

As illustrated in the example of FIG. 2, a feeding unit 16 is provided above the bottom plate 22 of the feed tray 20 that is set in the recessed portion 80. The feeding unit 16 includes a feeding roller 25, a feeding arm 26, and a power transmitting mechanism 27. The feeding roller 25 is supported at the distal end of the feeding arm 26. The feeding arm 26 is rotatable in a direction of an arrow 29 about a rod 28 provided at the proximal end thereof. Hence, the feeding roller 25 is movable to and away from the stack of recording sheets 12 supported by the bottom plate 22 of the feed tray 20 or the feed tray 20.

The feeding roller 25 is rotated by a driving force transmitted thereto from a transport motor (not illustrated) via the power transmitting mechanism 27. The power transmitting mechanism 27 includes a plurality of gears that are in mesh with one another. In this manner, the uppermost one of the recording sheets 12 on the bottom plate 22 of the feed tray 20 that is in contact with the feeding roller 25 is fed into a transport path 65 to be described below. The feeding roller 25 may be rotated by a driving force transmitted thereto from a motor provided separately from the transport motor.

[Transport Path 65]

As illustrated in the example of FIG. 2, the transport path 65 extends in the housing 14 from the rear end of the feed tray 20. The transport path 65 includes a bent portion 33 and a linear portion 34. The bent portion 33 extends from the rear end of the feed tray 20 while being bent upward. The linear portion 34 extends in the anteroposterior direction 8.

The bent portion 33 is defined by an outer guide member 18 and an inner guide member 19 that face each other with a predetermined gap interposed therebetween. The linear portion 34 is defined, at a position where a recording unit 24 is provided, by the recording unit 24 and a platen 42 that face each other with a predetermined gap interposed therebetween.

The recording sheets 12 supported by the feed tray 20 are each fed into the bent portion 33 by the feeding roller 25 and is transported from the bent portion 33 to the linear portion 34 in a transporting direction 15 represented by the dash-dot-line arrow illustrated in FIG. 2. That is, each of the recording sheets 12 is transported in the anteroposterior direction 8 (an exemplary transporting direction according to the present disclosure) in the linear portion 34.

[Recording Unit 24]

As illustrated in the example of FIG. 2, the recording unit 24 is provided above the linear portion 34. The recording unit 24 includes a carriage 40 and a recording head 38.

The carriage 40 is supported by two guide rails 56 and 57 that are spaced apart from each other in the anteroposterior direction 8, whereby the carriage 40 is movable back and forth in the lateral direction 9 (an exemplary scanning direction according to the present disclosure). The direction of the movement of the carriage 40 is the lateral direction 9 that is orthogonal to the transporting direction 15 in which the recording sheet 12 is transported, but is not limited to the lateral direction 9 as long as the direction of the movement of the carriage 40 crosses the transporting direction 15. The guide rails 56 and 57 will be described in detail separately below.

The recording head 38 is carried by the carriage 40. Ink is supplied from an ink cartridge (not illustrated) to the recording head 38. The recording head 38 has nozzles 39 in the lower surface thereof.

The platen 42 is provided at a position below the recording head 38 and faces the recording unit 24. The platen 42 supports the recording sheet 12 that is transported in the linear portion 34 of the transport path 65. The platen 42 will be described in detail separately below.

While the carriage 40 is moving in the lateral direction 9, the recording head 38 ejects ink droplets from the nozzles 39 toward the recording sheet 12 that is being transported in the transporting direction 15 while being supported by the platen 42. Thus, an image is recorded on the recording sheet 12.

[Guide Rails 56 and 57]

As illustrated in FIG. 2, the guide rail 56 is provided on the rear side with respect to the recording head 38 and supports a rear portion of the recording unit 24. The guide rail 57 (an exemplary first support member according to the present invention) is provided on the front side with respect to the recording head 38 and supports a front portion of the recording unit 24.

Figure 7:
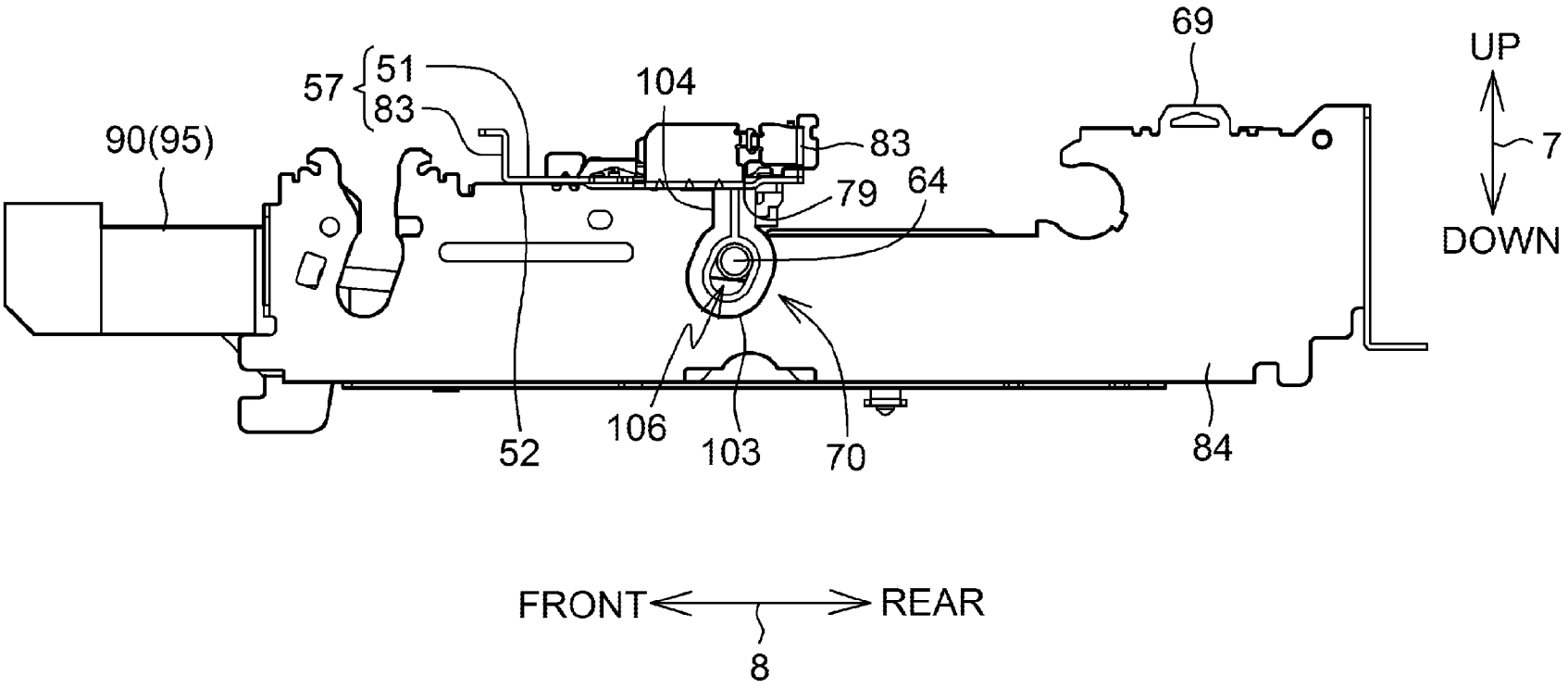
FIG. 7 is a right side view illustrating one of the side frames that is on the right side and associated elements.
Figure 8:
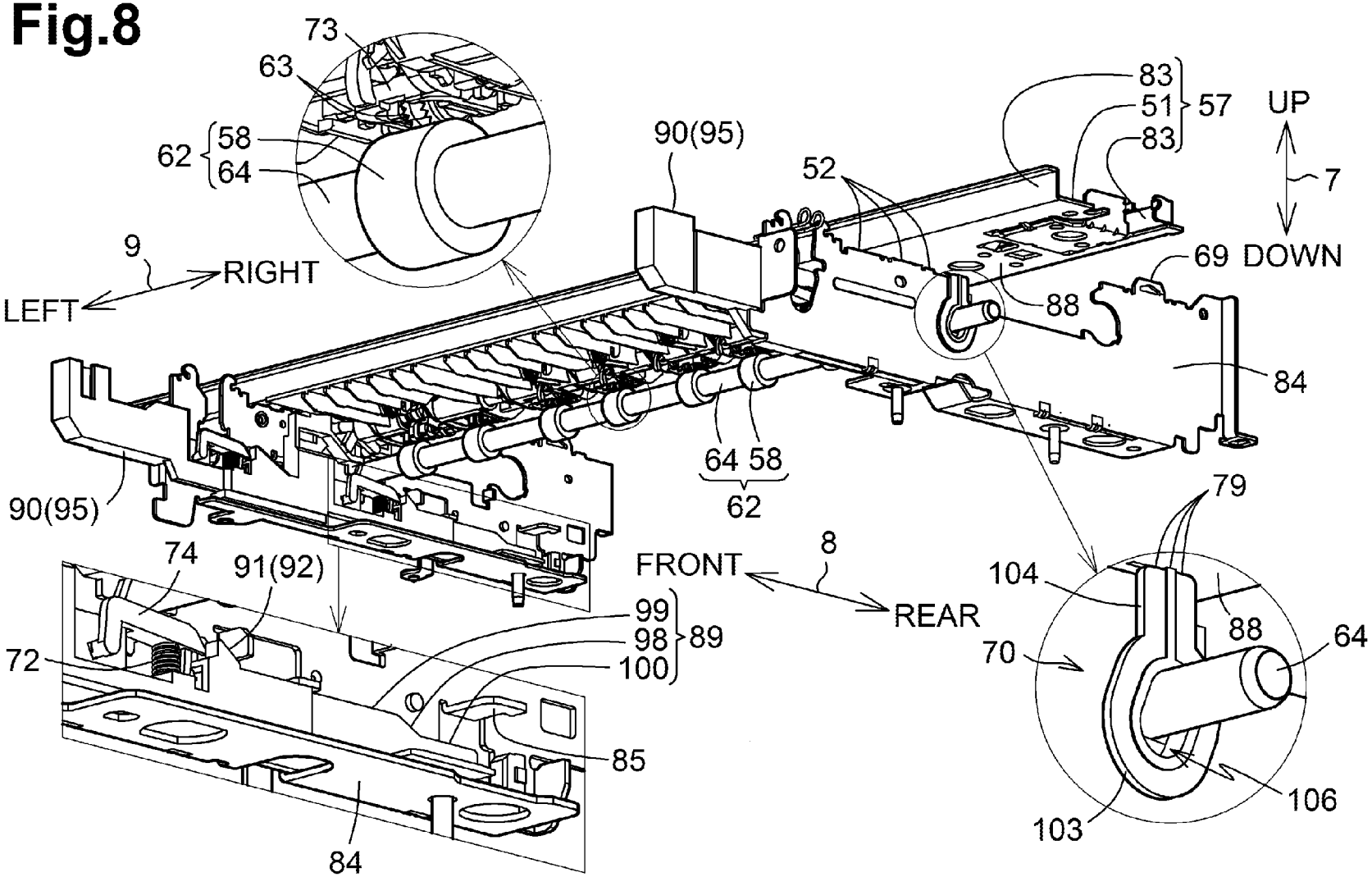
FIG. 8 is a perspective view illustrating a guide rail, the pair of side frames, the guiding portions, the second roller, and the bearings, with the lever unit residing at the rear position.
Figure 9:
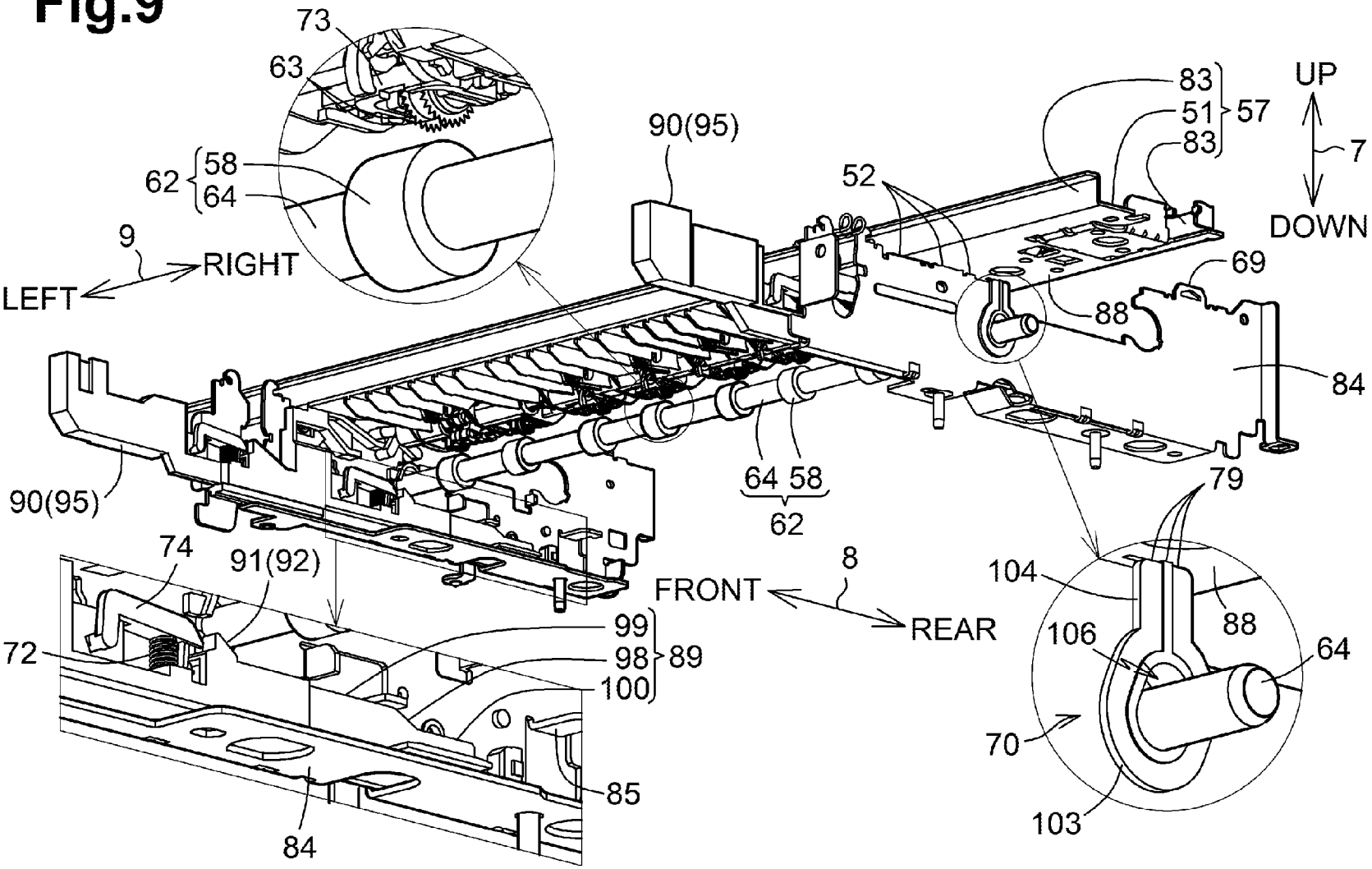
FIG. 9 is another perspective view illustrating the guide rail, the pair of side frames, the guiding portions, the second roller, and the bearings, with the lever unit residing at the front position.

As illustrated in FIGS. 7 to 9, the guide rails 56 and 57 each include a flat portion 51 extending in the lateral direction 9, and upright portions 83 extending upward from two respective ends, in the anteroposterior direction 8, of the flat portion 51. The flat portion 51 has a substantially flat-plate-like shape whose lengths in the anteroposterior direction 8 and in the lateral direction 9 are larger than that in the vertical direction 7.

In alternative embodiments, the positions of the upright portions 83 are not limited to the two respective ends of the guide rail 57 in the anteroposterior direction 8. For example, the upright portions 83 may be provided in a central part of the guide rail 57 in the anteroposterior direction 8. Moreover, the number of upright portions 83 may be one or more. The upright portions 83 are each preferably provided at a position that does not coincide with a position of a third projecting portion 104 of a corresponding one of bearings 70, to be described separately below, in the anteroposterior direction 8. Nevertheless, the upright portions 83 may each be provided at a position that coincides with the position of the third projecting portion 104 of the bearing 70 in the anteroposterior direction 8.

A known belt mechanism (not illustrated) is provided on the flat portion 51 of the guide rail 57. The belt mechanism includes pulleys provided at the right and left ends, respectively, on the upper surface of the guide rail 57, and a belt stretched between the pulleys. The belt is connected to the carriage 40 and to a carriage driving motor (not illustrated) that provides a driving force to the carriage 40. When the carriage driving motor is activated, a driving force acting in the lateral direction 9 is transmitted to the carriage 40 via the belt mechanism. Thus, the carriage 40 moves back and forth in the lateral direction 9.

[Side Frames 84]

Figure 4:
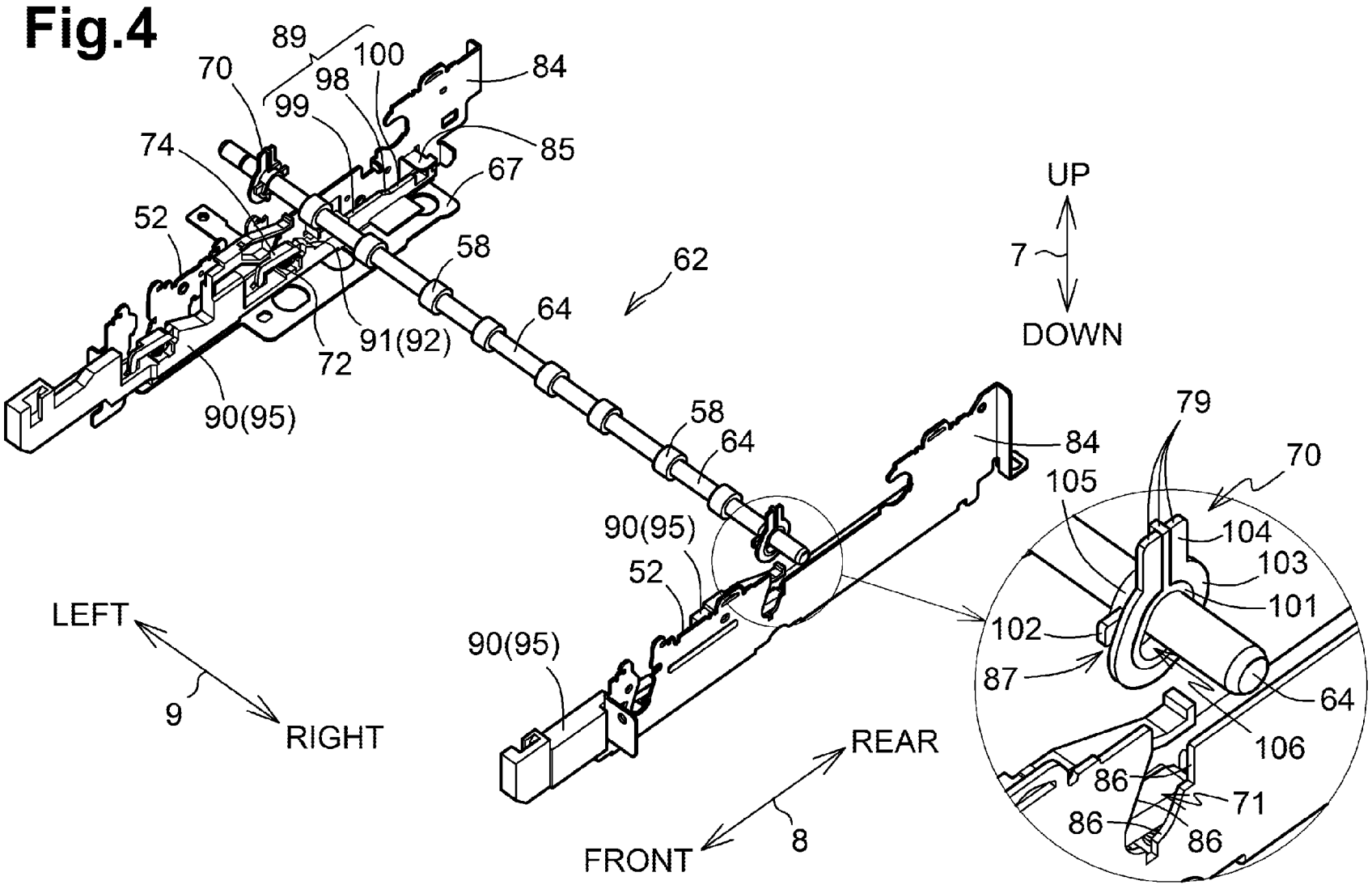
FIG. 4 is a perspective view illustrating a pair of side frames, the guiding portions, a second roller, and bearings, with the bearings not being fitted in the respective side frames and the lever unit residing at the rear position.
Figure 5:
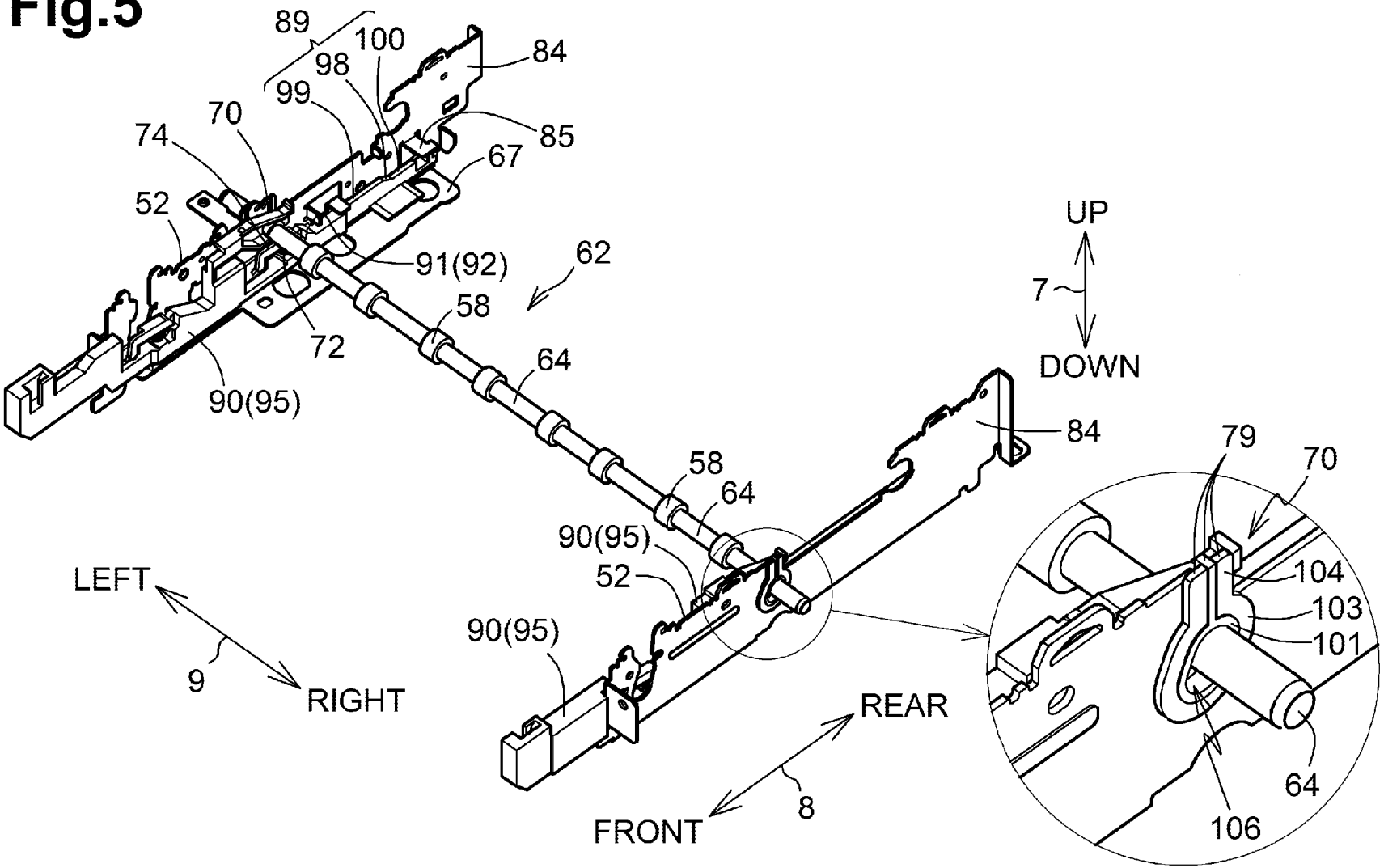
FIG. 5 is another perspective view illustrating the pair of side frames, the guiding portions, the second roller, and the bearings, with the bearings being fitted in the respective side frames and the lever unit residing at the rear position.

As illustrated in the example of FIGS. 4 and 5, the printer section 11 includes a pair of side frames 84 (exemplary second support member according to the present invention) that are spaced apart from each other in the lateral direction 9. The pair of side frames 84 are provided on right and left sides, respectively, in the lateral direction 9 with respect to the linear portion 34. The side frames 84 are each a substantially flat-plate-like member whose lengths in the vertical direction 7 and in the anteroposterior direction 8 are larger than that in the lateral direction 9.

As illustrated in the example of FIGS. 7 to 9, the pair of side frames 84 are provided below the guide rail 57 and support the guide rail 57 from below. The pair of side frames 84 also support the guide rail 56 at a position 69 that is on the rear side with respect to the position where the pair of side frames 84 support the guide rail 57. In FIGS. 7 to 9, the guide rail 56 is not illustrated.

As illustrated in the example of FIG. 4, a lower end portion of each of the pair of side frames 84 is bent toward the other side frame 84, that is, toward the inner side in the lateral direction 9. Upper surfaces 67 of the bent portions support a lever unit 90 to be described separately below.

As illustrated in the example of FIG. 4, the pair of side frames 84 each have a fitting portion 71 that is open in an arc shape and extends downward from the upper end thereof. The fitting portion 71 receives a corresponding one of the bearings 70 to be described separately below.

The pair of side frames 84 each have a projecting portion 85 (an exemplary platen contact portion according to the present invention) projecting toward the other side frame 84. The projecting portion 85 is provided on the rear side with respect to a second roller 62 to be described separately below. The projecting portion 85 is brought into contact with the upper surface of the platen 42, to be described separately below, from above (see FIG. 3A).

[First Pair of Rollers 59 and Second Pair of Rollers 44]

As illustrated in the example of FIG. 2, a first pair of rollers 59 is provided in the linear portion 34 on the upstream side in the transporting direction 15 with respect to the recording head 38 of the recording unit 24. The second pair of rollers 44 is provided in the linear portion 34 on the downstream side in the transporting direction 15 with respect to the recording head 38 of the recording unit 24.

The first pair of rollers 59 includes a first roller 60 provided on the lower side of the linear portion 34, and a pinch roller 61 provided on the upper side of the linear portion 34 and facing the first roller 60. The first roller 60 and the pinch roller 61 each rotate about an axis extending in the lateral direction 9. The pinch roller 61 is pressed against the first roller 60 by an urging member (not illustrated) such as a coil spring. Hence, when the first roller 60 rotates, the pinch roller 61 rotates by following the rotation of the first roller 60.

As illustrated in the example of FIG. 2, the second pair of rollers 44 includes the second roller 62 (an exemplary transporting roller according to the present invention) provided on the lower side of the linear portion 34, and a plurality of spurs 63 (an exemplary follower roller according to the present invention) provided on the upper side of the linear portion 34 and facing the second roller 62.

As illustrated in the example of FIG. 4, the second roller 62 includes a shaft 64 extending in the lateral direction 9, and roller members 58 provided on the shaft 64 at specific intervals in the lateral direction 9. That is, the second roller 62 extends in the lateral direction 9.

As illustrated in the example of FIG. 8, the spurs 63 that are arranged at specific intervals in the lateral direction 9 face the respective roller members 58. The spurs 63 are provided on the guide rail 57. More specifically, a shaft extending through the spurs 63 in the lateral direction 9 is rotatably supported by supporting members 73 provided on the lower surface of the guide rail 57.

Figure 3A:
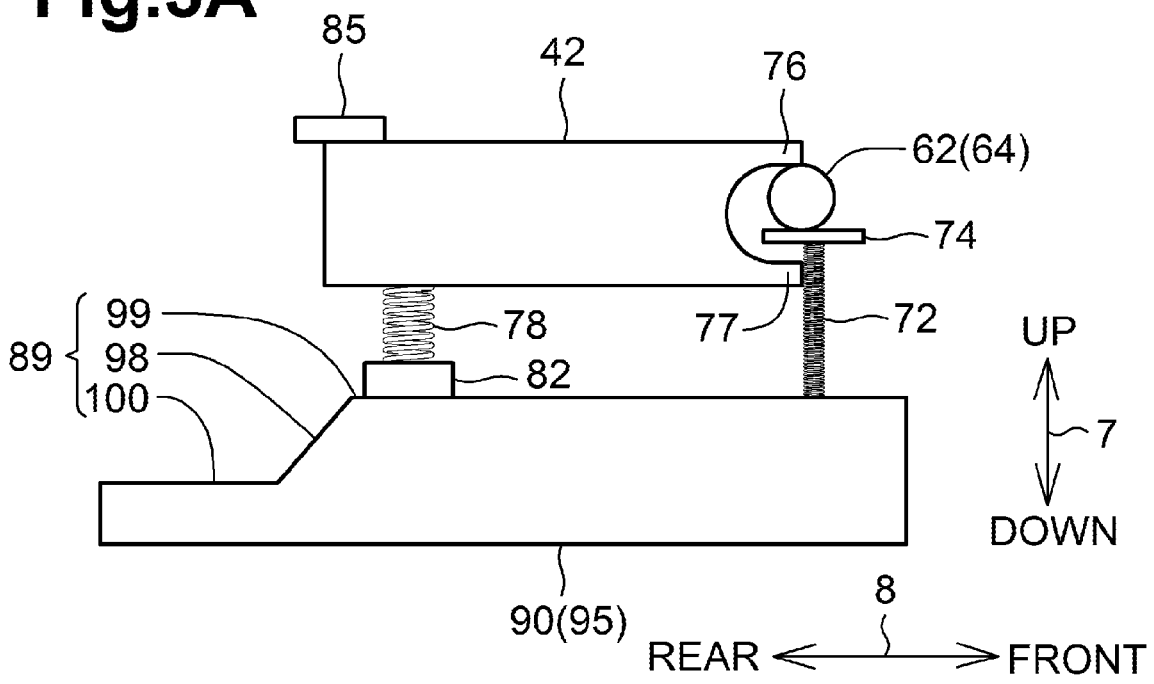
FIG. 3A is a left side view schematically illustrating part of the printer section including one of guiding portions of a lever unit, a platen, and associated elements, with the lever unit residing at a rear position.
Figure 3B:
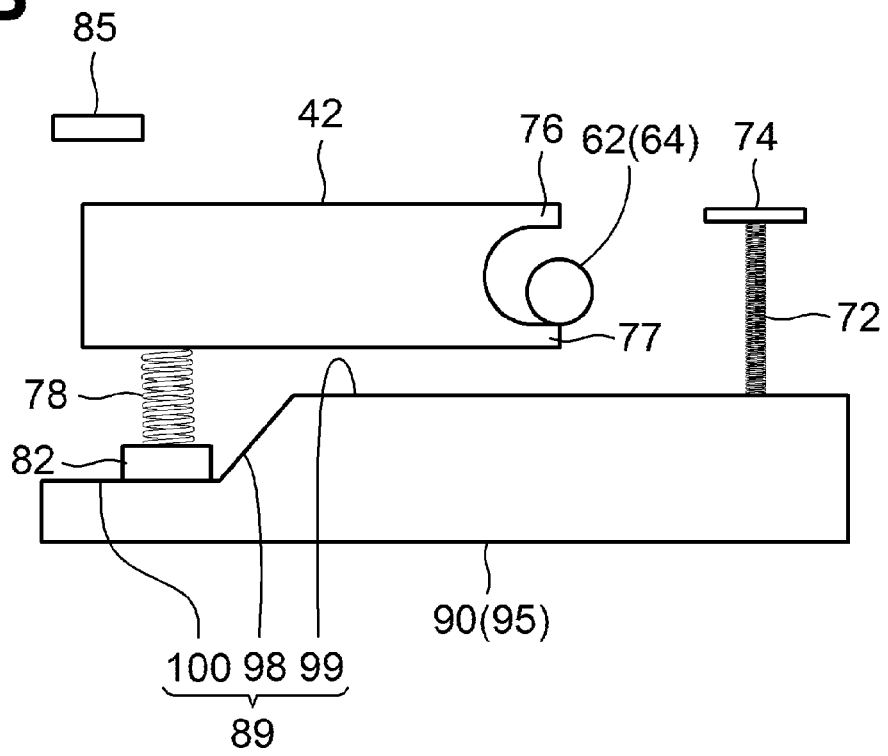
FIG. 3B is another left side view schematically illustrating the part of the printer section including the guiding portion of the lever unit, the platen, and associated elements, with the lever unit residing at a front position.

The second roller 62 is urged upward by coil springs 72 (exemplary first urging members according to the present invention, see FIG. 4). The coil springs 72 will now be described in detail. As illustrated in FIG. 4, the coil springs 72 are each connected to the lever unit 90 at the lower end thereof and to a corresponding one of supporting members 74 at the upper end thereof. The lever unit 90, to be described separately below, is movable. Hence, the coil springs 72 and the supporting members 74 move together with the lever unit 90. When the lever unit 90 is at a rear position as illustrated in FIGS. 5 and 8, the supporting members 74 are in contact with the shaft 64 of the second roller 62 from below. Hence, the coil springs 72 urge the second roller 62 upward, e.g., toward the spurs 63 when the second roller 62 and the spurs 63 are in the positions shown in FIG. 2 and the coil springs 72 are positioned and oriented as shown in FIGS. 3A-3B. Thus, the second roller 62 and the spurs 63 are in contact with each other, and, when the second roller 62 rotates, the spurs 63 rotate by following the rotation of the second roller 62.

The first roller 60 and the second roller 62 rotate by receiving a driving force transmitted thereto from the transport motor (not illustrated). When the first roller 60 rotates with a recording sheet 12 nipped between the first pair of rollers 59, the recording sheet 12 is transported onto the platen 42 by the first pair of rollers 59, that is, the recording sheet 12 is transported in the transporting direction 15. When the second roller 62 rotates with the recording sheet 12 nipped between the second pair of rollers 44, the recording sheet 12 is transported in the transporting direction 15 by the second pair of rollers 44 and is discharged onto the output tray 21 provided in the recessed portion 80.

The shaft 64 of the second roller 62 is provided with gears (not illustrated) that are rotatable about the shaft 64. The gears are in mesh with respective transmission gears so that the driving force from the transport motor is transmitted thereto. The gears on the shaft 64 are provided adjacent to the respective bearings 70 in the lateral direction 9. The bearings 70 will be described separately below.

[Platen 42]

The platen 42 has a substantially flat-plate-like shape whose lengths in the anteroposterior direction 8 and in the lateral direction 9 are larger than that in the vertical direction 7.

As illustrated in the examples of FIGS. 3A and 3B, the platen 42 has at the front end thereof a plurality of upper projections 76 (an exemplary roller contact portion according to the present invention) and a plurality of lower projections 77. The upper projections 76 and the lower projections 77 extend frontward from an upper portion and a lower portion, respectively, at the front end of the platen 42. The upper projections 76 and the lower projections 77 are arranged at specific intervals in the lateral direction 9. The positions of the upper projections 76 and the positions of the lower projections 77 in the lateral direction 9 may be the same as or different from each other.

The shaft 64 of the second roller 62 is placed in a space defined between the upper projections 76 and the lower projections 77 in the vertical direction 7. As illustrated in FIG. 3A, when the lever unit 90 is at the rear position, the upper projections 76 are in contact with the shaft 64 that is urged upward by the coil springs 72. Hence, the platen 42 is urged upward by the coil springs 72.

Coil springs 78 (an exemplary second urging member according to the present invention) are provided on the rear side with respect to the upper projections 76. The upper end of each of the coil springs 78 is connected to the lower surface of the platen 42. The lower end of each of the coil springs 78 is connected to a corresponding one of supporting members 82. The supporting members 82 are each supported by a corresponding one of guiding surfaces 89 of the lever unit 90. As illustrated in FIG. 3A, when the lever unit 90 is at the rear position, the platen 42 is urged upward by the coil springs 78 at positions, in the anteroposterior direction 8, not coinciding with the position where the upper projections 76 are provided. The upper surface of the platen 42 that is urged upward by the coil springs 78 is in contact with the projecting portions 85 from below. The projecting portions 85 are provided on the respective side frames 84. That is, the projecting portions 85 stop the upward movement of the platen 42 that is urged by coil springs 78. Thus, the state of contact between the upper projections 76 and the shaft 64 of the second roller 62 is maintained.

[Bearing 70]

As illustrated in the example of FIG. 4, the bearings 70 each include a cylindrical body 101 having an opening 106, a first projecting portion 102 projecting from an outer circumferential surface 105 of the cylindrical body 101, a second projecting portion 103 spaced apart from the first projecting portion 102 in the lateral direction 9 and projecting from the outer circumferential surface 105, and the third projecting portion 104 projecting from the second projecting portion 103.

The following description of the bearing 70 is given on the basis of a state where the bearing 70 is oriented as illustrated in FIG. 4 and with reference to the vertical direction 7, the anteroposterior direction 8, and the lateral direction 9.

The length of the body 101 in the anteroposterior direction 8 is substantially the same as the inside diameter of the fitting portion 71. The opening 106 is an oblong hole extending substantially in the vertical direction 7 (an exemplary direction that crosses the transporting direction and the scanning direction according to the present invention). In the embodiment, the opening 106 extends obliquely with respect to the vertical direction 7 with the upper end thereof residing on the rear side with respect to the lower end thereof. The direction in which the opening 106 extends is not limited to such a direction and may be any direction that crosses the anteroposterior direction 8 and the lateral direction 9. For example, the opening 106 may extend in the vertical direction 7.

The length of the opening 106 in the long-side direction thereof (in the vertical direction 7) corresponds to the length of travel of the second roller 62, to be described separately below, in the vertical direction 7. The length of the opening 106 in the short-side direction (the anteroposterior direction 8) is substantially the same as the diameter of the shaft 64 of the second roller 62. A groove 87 is provided between the first projecting portion 102 and the second projecting portion 103. The width of the groove 87 (the length in the lateral direction 9) is substantially the same as the length of each of the pair of side frames 84 in the lateral direction 9, i.e., the thickness of an edge portion 86 defining the fitting portion 71.

As illustrated in the examples of FIGS. 4 and 5, the bearing 70 is fitted into the fitting portion 71 of a corresponding one of the pair of side frames 84 from above with the third projecting portion 104 being oriented upward. More specifically, the edge portion 86 defining the fitting portion 71 is inserted into the groove 87 provided between the first projecting portion 102 and the second projecting portion 103, whereby the bearing 70 is fitted in the fitting portion 71. That is, the groove 87 is fitted onto the fitting portion 71. In this manner, the bearings 70 are positioned on the pair of side frames 84 as illustrated in FIG. 5. While FIG. 4 illustrates a state where the bearings 70 are yet to be fitted in the respective fitting portions 71, FIG. 5 illustrates a state where the bearings 70 have been fitted in the respective fitting portions 71.

The shaft 64 of the second roller 62 is inserted into the openings 106. The second roller 62 that extends through the openings 106 is rotatable. Since the openings 106 extend in the vertical direction 7 as described above, the shaft 64 is movable in the vertical direction 7 along the openings 106. FIGS. 5 and 8 illustrate a state where the shaft 64 is in contact with the upper ends of the openings 106. FIG. 9 illustrates a state where the shaft 64 is in contact with the lower ends of the openings 106. In the state illustrated in FIG. 9, the bearings 70 support the shaft 64 of the second roller 62 while allowing the rotation of the shaft 64.

As illustrated in FIGS. 7 to 9, when the bearings 70 are in the respective fitting portions 71, upper surfaces 79 (an exemplary contact portion according to the present invention) of the third projecting portions 104 are in contact with a lower surface 88 of the flat portion 51 of the guide rail 57 from below. The upper surfaces 79 are each longer in the anteroposterior direction 8 than in the lateral direction 9. The pair of side frames 84 are each longer in the anteroposterior direction 8 than in the lateral direction 9. That is, the upper surfaces 79 extend along the respective side frames 84.

As illustrated in FIGS. 8 and 9, positions 52 where the pair of side frames 84 support the guide rail 57 are on the front side with respect to the positions where the upper surfaces 79 of the third projecting portions 104 are in contact with the flat portion 51 of the guide rail 57 from below. That is, the positions 52 do not coincide, in the transporting direction 15, with the positions of contact between the guide rail 57 and the upper surfaces 79.

When the bearings 70 are in the respective fitting portions 71 as illustrated in FIG. 5, the third projecting portion 104 of one of the bearings 70 that is on the right side resides on the right side in the lateral direction 9 with respect to the positions 52 of the side frame 84 that is on the right side, while the third projecting portion 104 of the other bearing 70 that is on the left side resides on the left side in the lateral direction 9 with respect to the positions 52 of the side frame 84 that is on the left side. In other words, the upper surfaces 79 of the third projecting portions 104 reside on the outer side in the lateral direction 9 with respect to the positions 52 where the pair of side frames 84 support the flat portion 51 of the guide rail 57.

[Lever Unit 90]

As illustrated in FIGS. 4 and 5, the printer section 11 includes the lever unit 90. The lever unit 90 is supported by the upper surfaces 67 of the bent portions of the pair of side frames 84 in such a manner as to be movable in the anteroposterior direction 8. The lever unit 90 is movable between the rear position illustrated in FIGS. 5 and 8 and a front position illustrated in FIG. 9 that is on the front side with respect to the rear position.

Figure 6:
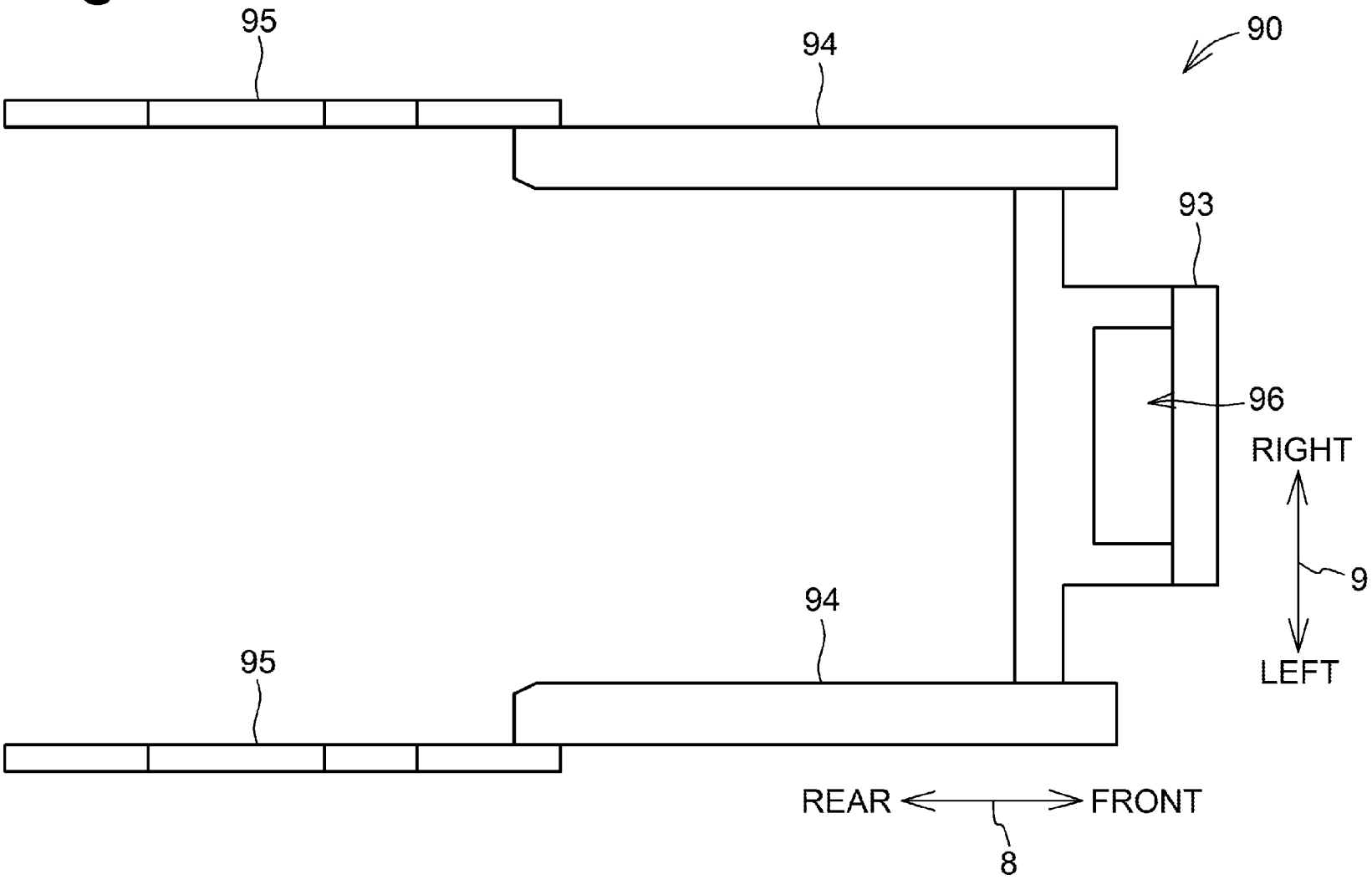
FIG. 6 is a plan view schematically illustrating the lever unit.

As illustrated in FIG. 6, the lever unit 90 includes a handle 93 to be gripped by the user, a pair of connecting portions 94 extending rearward from the right and left ends, respectively, of the handle 93, and a pair of guiding portions 95 extending rearward from the rear ends of the respective connecting portions 94.

As illustrated in FIG. 1, the handle 93 resides in the recessed portion 80 and near the opening 13, more specifically, near the upper end of the opening 13. As illustrated in FIG. 6, the handle 93 extends in the lateral direction 9 and has an opening 96 in a central portion thereof in the lateral direction 9. The user puts his or her fingers into the opening 96 and grips the handle 93.

As illustrated in FIG. 6, the pair of connecting portions 94 are each a long, flat-plate-like member whose long-side direction corresponds to the anteroposterior direction 8. One of the pair of connecting portions 94 resides near the upper right corner of the recessed portion 80 and extends in the anteroposterior direction 8. The other connecting portion 94 resides near the upper left corner of the recessed portion 80 and extends in the anteroposterior direction 8. The housing 14 of the printer section 11 has grooves (not illustrated) provided in inner walls 81 (see FIG. 1) thereof and extending in the anteroposterior direction 8. The pair of connecting portions 94 have respective projections (not illustrated) projecting toward the grooves. The projections are fitted into the respective grooves. Hence, when the user grips and moves the handle 93, the connecting portions 94 and the guiding portions 95 to be described separately below move in the anteroposterior direction 8. The configuration of supporting the connecting portions 94 by using the housing 14 is not limited to the one described above.

As illustrated in FIGS. 4 and 5, the guiding portions 95 extend in the anteroposterior direction 8 over a range from the second pair of rollers 44 to the rear side of the first pair of rollers 59. The guiding portions 95 are provided in a pair, with one of them residing on the right side with respect to the right end of the transport path 65 and the other residing on the left side with respect to the left end of the transport path 65. The guiding portions 95 are supported by the respective upper surfaces 67.

The guiding portions 95 each have a guiding surface 91 and the guiding surface 89. The guiding surface 91 includes a sloping surface 92 whose front end is at a higher position than the rear end thereof. The guiding surface 89 includes a sloping surface 98 whose front end is at a higher position than the rear end thereof, a horizontal surface 99 that is continuous with the front end of the sloping surface 98 and extends in the anteroposterior direction 8, and a horizontal surface 100 that is continuous with the rear end of the sloping surface 98 and extends in the anteroposterior direction 8.

[Movements of Second Roller 62 and Platen 42]

A vertical movement of the second pair of rollers 44 that occurs along with the movement of the lever unit 90, will now be described. When the lever unit 90 is at the rear position as illustrated in FIGS. 5 and 8, the shaft 64 of the second roller 62 is supported by the supporting members 74. Hence, the shaft 64 is urged upward by the coil springs 72. Consequently, the shaft 64 is in contact with the upper ends of the openings 106 of the bearings 70 from below. Furthermore, the shaft 64 is in contact with the upper projections 76 of the platen 42 from below (see FIG. 3A).

When the user grips the handle 93 and pulls the lever unit 90 frontward, the lever unit 90 moves frontward from the rear position. Hence, the supporting members 74 move frontward and away from the shaft 64. Consequently, the shaft 64 that is under its own weight is supported by the sloping surfaces 92. With the frontward movement of the lever unit 90, the shaft 64 slides on the sloping surfaces 92. Since the shaft 64 slides on the sloping surfaces 92, the shaft 64 moves downward away from the upper ends of the openings 106 of the bearings 70. The shaft 64 also moves away from the upper projections 76 of the platen 42. Subsequently, when the lever unit 90 reaches the front position as illustrated in FIG. 9, the shaft 64 is supported at the lower ends of the openings 106 of the bearings 70.

A vertical movement of the platen 42 that occurs along with the movement of the lever unit 90 will now be described. As described above, when the lever unit 90 is at the rear position, the shaft 64 of the second roller 62 is in contact with the upper projections 76 of the platen 42 from below as illustrated in FIG. 3A.

Furthermore, the supporting members 82 connected to the platen 42 via the respective coil springs 78 are supported by the respective horizontal surfaces 99 of the lever unit 90. In this state, the platen 42 is urged upward by the coil springs 78. Consequently, the upper surface of the platen 42 is in contact with the projecting portions 85 of the pair of side frames 84 from below.

When the lever unit 90 is moved frontward from the rear position, the shaft 64 moves downward as described above. Hence, the shaft 64 moves away from the upper projections 76 and presses the lower projections 77 from above. Consequently, the front side of the platen 42 moves downward.

Furthermore, when the lever unit 90 is moved frontward from the rear position, the supporting members 82 leave the respective horizontal surfaces 99 and come to be supported by the respective sloping surfaces 98. When the lever unit 90 is further moved frontward, the supporting members 82 move downward by sliding on and moving relative to the respective sloping surfaces 98. Thus, the coil springs 78 and the rear side of the platen 42 move downward, whereby the rear side of the platen 42 moves away from the projecting portions 85. Ultimately, when the lever unit 90 reaches the front position, the supporting members 82 are supported by the respective horizontal surfaces 100 as illustrated in FIG. 3B. In this manner, the platen 42 moves downward.

When the lever unit 90 is at the rear position, the second roller 62 and the spurs 63 are in contact with each other and are capable of transporting the recording sheet 12 while nipping the recording sheet 12 therebetween. When the lever unit 90 is at the front position, the second roller 62 and the spurs 63 are spaced apart from each other. When the lever unit 90 is at the rear position, the position of the platen 42 in the vertical direction 7 is determined such that the distance between the recording head 38 and the recording sheet 12 that is supported by the platen 42 is suitable for image recording.

When the lever unit 90 is moved from the front position to the rear position, the movement described above is realized in the reverse order. That is, the shaft 64 moves away from the sloping surfaces 92 and comes to be supported by the supporting members 74, whereby the shaft 64 moves upward. Furthermore, the upper projections 76 are pushed upward by the shaft 64 that moves as described above, whereby the front side of the platen 42 moves upward. Furthermore, the supporting members 82 leave the respective horizontal surfaces 100, move along the respective sloping surfaces 98, and come to be supported by the respective horizontal surfaces 99, whereby the rear side of the platen 42 moves upward.

[Effects Produced by Embodiment]

According to some example embodiments contemplated herein, the upper surfaces 79 of the bearings 70 are in contact with the guide rail 57 from below. Furthermore, the guide rail 57 supports the carriage 40 that carries the recording head 38. Hence, the recording head 38 and the second roller 62 are positioned with reference to the guide rail 57. Therefore, the accuracy in the relative positions of the recording head 38 and the second roller 62 is improved. Consequently, the accuracy in the relative positions of the carriage 40 carrying the recording head 38 and the second roller 62 supported by the bearings 70 is improved.

According to some example embodiments, the coil springs 72 urge the second roller 62 upward, whereby the accuracy in the position of the second roller 62 with respect to the recording head 38 is further improved.

According to some example embodiments, the openings 106 each extend obliquely with respect to the vertical direction 7 with the upper end thereof residing on the rear side with respect to the lower end thereof. Hence, the second roller 62 is movable in the vertical direction 7. Even in such a case, the second roller 62 is positioned by the coil springs 72 and at ends of the respective openings 106 that are nearer to the guide rail 57.

According to some example embodiments, the upper projections 76 of the platen 42 are in contact with the shaft 64 of the second roller 62 from above. Therefore, a portion of the platen 42 near the upper projections 76, i.e., the front side of the platen 42, is positioned with reference to the guide rail 57. Hence, the accuracy in the relative positions of the platen 42, the recording head 38, and the second roller 62 is improved.

According to some example embodiments, the bearings 70 are each fitted into a corresponding one of the pair of side frames 84 from above with the groove 87 between the first projecting portion 102 and the second projecting portion 103 being fitted onto the fitting portion 71. That is, there is no need to fit the bearings 70 into the respective side frames 84 in the lateral direction 9. Therefore, the bearings 70 are attachable to the respective side frames 84 even if there are no spaces for moving the bearings 70 in the lateral direction 9. Hence, the increase in the size of the multifunction machine 10 in the lateral direction 9 is suppressed.

According to some example embodiments, the spurs 63 are supported by the guide rail 57. Therefore, as with the recording head 38 and the second roller 62, the spurs 63 are positioned with reference to the guide rail 57. Hence, the accuracy in the relative positions of the spurs 63, the recording head 38, and the second roller 62 is improved.

According to some example embodiments, the guide rail 57 is supported at two positions that are different in the anteroposterior direction 8. Therefore, the position of the guide rail 57 is stabilized.

According to some example embodiments, since the flat portion 51 of the guide rail 57 extends in the lateral direction 9, the carriage 40 is easily supported in such a manner as to be movable in the lateral direction 9.

According to some example embodiments, since the upright portions 83 are provided, the rigidity of the guide rail 57 is increased. Hence, the guide rail 57 does not tend to bend easily. Consequently, the positional shift of the carriage 40, which is supported by the guide rail 57, due to the bending of the guide rail 57 is reduced.

[Modifications]

While the above embodiments describe examples where the respective openings 106 of the bearings 70 extend in the vertical direction 7, the openings 106 may each have a circular shape instead of extending in the vertical direction 7. In that case, the shaft 64 of the second roller 62 extending through the openings 106 is not vertically movable, unlike the case according to the above embodiment.

If the second roller 62 is not vertically movable as described above, the coil springs 72 may urge the respective bearings 70 instead of the second roller 62. In that case, the coil springs 72 urge the second roller 62 via the respective bearings 70.

While the above embodiments concern instances where the second roller 62 corresponds to the transporting roller according to the present invention, the first roller 60 may correspond to the transporting roller according to the present invention and may be supported by bearings each having the same shape as the bearing 70. Moreover, if any other roller is provided in the multifunction machine 10, that roller may correspond to the transporting roller according to the present invention and may be supported by bearings each having the same shape as the bearing 70.

While the above embodiments concern instances where the guide rail 57 corresponds to the first support member according to the present invention, the guide rail 56 may correspond to an exemplary first support member according to the present disclosure. In that case, the first roller 60 provided below the guide rail 56 corresponds to the transporting roller according to the present invention, and the first roller 60 is supported by bearings each having the same shape as the bearing 70 such that the upper surfaces of the bearings are in contact with the guide rail 56 from below.

While the above embodiments concern instances where the upper surface of the platen 42 that is urged upward by the coil springs 78 comes into contact with the projecting portions 85 of the pair of side frames 84 from below, the upper surface may come into contact with either of the guide rails 56 and 57 from below. In that case, portions of the guide rail 56 or 57 to which the upper surface comes into contact correspond to exemplary platen contact portion according to the present invention.

If, in some embodiments, the upper surface of the platen 42 comes into contact with either of the guide rails 56 and 57 from below as described above, the rear side of the platen 42 is positioned with reference to the guide rail 56 or 57. In this case, the front side of the platen 42 is also positioned with reference to the guide rail 56 or 57 as described in the above embodiment. That is, the entirety of the platen 42 is positioned with reference to the guide rail 56 or 57. Consequently, the accuracy in the relative positions of the platen 42, the recording head 38, and the second roller 62 is improved.

While the above embodiments concern instances where the second roller 62 is vertically movable, the first roller 60 may also be vertically movable. In that case, the first roller 60 may be vertically moved by a known mechanism or by a mechanism that is the same as the mechanism that vertically moves the second roller 62.

If, in such embodiments, the first roller 60, the second roller 62, and the platen 42 are vertically movable, the multifunction machine 10 is capable of transporting, along the linear portion 34, not only the recording sheet 12 but also a recording medium that is thicker than the recording sheet 12, such as a compact-disc read-only memory (CD-ROM) or a digital-versatile-disc read-only memory (DVD-ROM), or a medium tray supporting such a recording medium. Furthermore, if the first roller 60, the second roller 62, and the platen 42 are vertically movable, any recording sheet 12 that may be stuck in the linear portion 34 is easily removable.

Although in the example embodiments discussed herein, various relative directions are disclosed, including but not limited to up, down, left, right, rear, front, and vertical or horizontal directions, it is noted that these terms are intended to represent relative positions of elements of the embodiments described herein, and not intended to describe absolute relative positions of the components, members, or machine disclosed. Rather, other orientations of the various components discussed herein are contemplated, and as such the present disclosure is not limited to the directional arrangement described above in connection with some embodiments.

The description and illustration of one or more embodiments provided in this application are not intended to limit or restrict the scope of the invention as claimed in any way. The embodiments, examples, and details provided in this application are considered sufficient to convey possession and enable others to make and use the best mode of claimed invention. The claimed invention should not be construed as being limited to any embodiment, example, or detail provided in this application. Regardless of whether shown and described in combination or separately, the various features (both structural and methodological) are intended to be selectively included or omitted to produce an embodiment with a particular set of features. Having been provided with the description and illustration of the present application, one skilled in the art may envision variations, modifications, and alternate embodiments falling within the spirit of the broader aspects of the general inventive concept embodied in this application that do not depart from the broader scope of the claimed invention.

What is claimed is:

1. An inkjet recording apparatus comprising:

a carriage configured to support a recording head that is configured to eject ink from nozzles onto a recording medium to be conveyed;

a first support member supporting the carriage, the carriage being movable in a scanning direction orthogonal to a transporting direction of the recording medium;

a second support member separate from and configured to support the first support member;

a transporting roller extending in the scanning direction and rotatable to transport the recording medium in the transporting direction; and a bearing disposed at the second support member and supporting the transporting roller rotatably, the bearing comprising a flat upper surface that contacts the first support member and a contact member comprising a first projecting portion and a second projecting portion, wherein the second support member is secured between the first and second projecting portions and wherein the first projecting portion and the second projecting portion are positioned along a line parallel with an axis of the transport roller in the scanning direction.

2. The inkjet recording apparatus of claim 1, whereby relative positions of the carriage and transporting roller in a direction orthogonal to both the scanning direction and the transporting direction are maintained.

3. The inkjet recording apparatus of claim 1, wherein the bearing is attached to the second support member.

4. The inkjet recording apparatus of claim 1, wherein the flat upper surface is offset in a scanning direction from the second support member.

5. The inkjet recording apparatus according to claim 1, further comprising:

a pair of second support members configured to support the first support member, the second support members spaced apart from each other in the scanning direction; and a pair of bearings, the bearings disposed at the second support members, respectively; and wherein the each of the pair of bearings comprising the contact member.

6. The inkjet recording apparatus according to claim 1, further comprising a first urging member configured to urge one of the bearing and the transporting roller toward the first support member.

7. The inkjet recording apparatus according to claim 6, wherein the bearing has an opening through which the transporting roller passes, wherein the opening extends in a direction orthogonal to both the transporting direction and the scanning direction, and wherein the first urging member is configured to urge the transporting roller toward the first support member.

8. The inkjet recording apparatus according to claim 1, further comprising:

a platen facing the recording head and configured to support the recording medium conveyed by the transporting roller, the platen comprising a roller contact portion configured to contact the transporting roller, a platen contact portion disposed at one of the first support member and the second support member and configured to contact the platen, and a second urging member configured to urge the platen toward the platen contact portion.

9. The inkjet recording apparatus according to claim 8, further comprising a first urging member configured to urge the transporting roller toward the first support member, wherein the roller contact portion is located between the first support member and the transporting roller in a direction orthogonal to both the transporting direction and the scanning direction, wherein the platen portion is located at a position different from the roller contact portion in the transporting direction, and wherein the second urging member is located at a position different from the first urging member in the transporting direction.

10. The inkjet recording apparatus according to claim 1, wherein the second support member comprises a fitting portion that has an opening extending from an upper end of the second support member, wherein the bearing comprises a first projecting portion projecting from a circumferential surface of the bearing and a second projecting portion projecting from the circumferential surface of the bearing and spaced apart from the first projecting portion in the scanning direction, and wherein the bearing is configured to engage with the fitting portion such that the fitting portion is located between the first projecting portion and the second projecting portion.

11. The inkjet recording apparatus according to claim 1, further comprising a follower roller disposed facing the transporting roller, wherein the transporting roller and the follower roller are configured to nip the recording medium there between and transport the recording medium, and wherein the follower roller is disposed at the first support member.

12. The inkjet recording apparatus according to claim 1, wherein a position where the second support member supports the first support member is different from a position where the contact portion is in contact with the first support member with respect to the transporting direction.

13. The inkjet recording apparatus according to claim 1, wherein the first support member comprises a flat portion extending in the scanning direction, and wherein the contact portion is configured to contact the flat portion.

14. The inkjet recording apparatus according to claim 13, wherein the flat portion comprises an upright portion that extends from an end portion of flat portion in the transporting direction.

15. The inkjet recording apparatus according to claim 1, wherein the support member including a first surface and a second surface, the first surface being opposite to the second surface in a direction perpendicular to both the transporting direction and the scanning direction, wherein the carriage contacts the first surface of the first support member, and wherein the contact portion contacts the second surface of the first support member.

16. A method of operation of an inkjet recording apparatus, the method comprising:

movably mounting a carriage to a first support member, the carriage configured to support a recording head that is configured to eject ink from nozzles onto a recording medium to be conveyed;

positioning a bearing at a second support member separate from the first support member and at a contact member comprising a first projecting portion and a second projecting portion, wherein the second support member is secured between the first and second projecting portions, the bearing rotatably supporting a transporting roller that extends in a scanning direction and wherein the first projecting portion and the second projecting portion are positioned along a line parallel with an axis of the transport roller in the scanning direction; and maintaining contact between a flat upper surface of the bearing and the first support member.

17. The method of claim 16, further comprising maintaining relative positions of the carriage and transporting roller in a direction orthogonal to both the scanning direction and the transporting direction.

18. An inkjet recording apparatus comprising:

a carriage configured to support a recording head that is configured to eject ink from nozzles onto a recording medium to be conveyed;

a guide rail supporting the carriage, the carriage being movable in a scanning direction orthogonal to a transporting direction of the recording medium;

at least one side frame supporting the guide rail;

a transporting roller extending in the scanning direction and rotatable to transport the recording medium in the transporting direction; and a bearing attached to the at least one side frame and supporting the transporting roller rotatably, the bearing comprising a contact portion comprising a first projecting portion and a second projecting portion, wherein the at least one side frame is secured between the first and second projecting portions at an opening of the at least one side frame, and wherein the first projecting portion and the second projecting portion are positioned along a line parallel with an axis of the transport roller in the scanning direction.

* * * * *